US005937655A

United States Patent [19]

Weiler et al.

[11] Patent Number: 5,937,655

[45] Date of Patent: Aug. 17, 1999

[54] PRESSURE BUILDING DEVICE FOR A CRYOGENIC TANK

[75] Inventors: James M. Weiler, Shakopee; Ryan A. Erickson, Farmington; Scott Darrell Isebrand, Minneapolis; Audrey Duane Preston, New Prague, all of Minn.

[73] Assignee: MVE, Inc., New Prague, Minn.

[21] Appl. No.: 08/984,743

[22] Filed: Dec. 4, 1997

[51] Int. Cl.[6] ..... F17C 7/02

[52] U.S. Cl. ..... 62/50.1; 62/50.2

[58] Field of Search ..... 62/45.1, 50.1, 62/50.2, 51.1

[56] References Cited

U.S. PATENT DOCUMENTS

| | | | |
|---|---|---|---|
| 2,401,651 | 6/1946 | Mathis et al. | 62/50.2 |
| 2,958,204 | 11/1960 | Spaulding | 62/45.1 |
| 3,245,248 | 4/1966 | Ritter . | |
| 3,272,964 | 9/1966 | Carlos et al. . | |
| 3,440,829 | 4/1969 | Davies-White | 62/50.2 X |
| 3,648,018 | 3/1972 | Cheng et al. . | |
| 3,690,024 | 9/1972 | Osrow . | |
| 4,201,319 | 5/1980 | Andrea et al. . | |
| 4,219,725 | 8/1980 | Groninger | 62/50.2 |
| 4,313,306 | 2/1982 | Torre . | |
| 4,472,946 | 9/1984 | Zwick . | |
| 4,608,831 | 9/1986 | Gustafson | 62/50.2 |
| 4,791,788 | 12/1988 | Simmonds et al. | 62/51.1 |
| 4,854,128 | 8/1989 | Zeamer | 62/50.1 |
| 4,899,546 | 2/1990 | Eigenbrod | 62/50.2 |
| 5,537,824 | 7/1996 | Gustafson et al. . | |

*Primary Examiner*—Christopher B. Kilner
*Attorney, Agent, or Firm*—Rudnick & Wolfe

[57] ABSTRACT

A device for pressurizing a tank containing a supply of cryogenic liquid features a tubular enclosure disposed within the cryogenic liquid. The tubular enclosure features an opening in its bottom and is in communication with a pressure builder coil external to the tank. The vapor side of the pressure builder coil is in communication with the head space of the tank. An electric heater element is disposed in the bottom of the tubular enclosure. An insulating tube may optionally be disposed about the tubular enclosure. In addition, a ball may optionally be positioned adjacent the opening in the tubular enclosure so that a check valve is formed. The device fits through the tops of existing cryogenic tanks.

12 Claims, 2 Drawing Sheets

PRESSURE BUILDING DEVICE FOR A CRYOGENIC TANK

BACKGROUND

Cryogenic fluids, that is, fluids that have boiling points below −150° F. at atmospheric pressure, are used in a variety of applications. Many of these applications require that the cryogen be supplied as a gas at a pressure around 400 psi. For example, high pressure nitrogen and argon gases are required for laser welding while high pressure nitrogen, oxygen and argon gases are required for laser cutting.

The cryogens for such applications are stored as liquids, however, because one volume of liquid produces many volumes of gas (600–900 volumes of gas per volume of liquid) when the liquid is allowed to vaporize (boil) and warm to ambient temperature. To store an equivalent amount of gas would require that the gas be stored at a very high pressure. This would mandate the use of larger and heavier containers for storage and expensive, high maintenance compressors or pumps to create the storage pressure.

As a result, systems that provide high pressure gas to an application from a relatively low pressure liquid have been developed. Such systems must supply the cryogenic liquid to a heat exchanger at the desired transfer pressure (around 400 psi for the above applications). While special pumps or compressors may be used for this purpose, they feature moving parts that wear and thus require repair, replacement and maintenance. Furthermore, pumps or compressors add considerable cost to the production, and thus purchase price, of a transfer system.

An alternative method of creating the desired transfer pressure is to pressurize the tank within which the bulk supply of cryogenic liquid is stored. Such a system is available from MVE, Inc. of New Prague, Minn. This system utilizes a bulk cryogenic storage tank. The pressure within the storage tank is increased by gravity feeding cryogenic liquid to a heat exchanger. The vapor created thereby is returned to the storage tank so that the pressure within the tank is increased. Cryogenic liquid from within the bulk tank is then delivered to the application at the desired transfer pressure to be used as liquid, or is itself vaporized in another heat exchanger if gas is required.

While this type of system works well, cryogenic bulk storage tanks that are able to withstand pressures in the 400 psi range are expensive when compared to their lower pressure counterparts. It is preferable in many instances for a system to utilize a low pressure tank to store a bulk quantity of cryogenic liquid with cryogenic liquid therefrom flowing to a smaller transfer tank that may be pressurized.

Such transfer tanks may be pressurized in several ways. One way is to heat the fluid in the transfer tank directly with electric heaters. While this will increase the pressure within the transfer tank, it will also warm the cryogenic liquid therein to a saturated state. As a result, if the system sits unused for a period of time, heat leakage into the transfer tank will eventually cause a portion of the saturated cryogenic liquid to boil off. This will potentially increase the pressure in the tank to a level above the tank safety valve setting causing a portion of the cryogenic vapor to be vented to the atmosphere. This is undesirable. Venting is both wasteful and may be unsafe or detrimental to the environment.

Another way of pressurizing a transfer tank is to feed the cryogenic liquid therein to a pressure builder heat exchanger. The vapor produced thereby is then returned to the vapor space above the cryogenic liquid to pressurize the tank. Such a system requires a means of transporting the cryogenic liquid within the transfer tank to the heat exchanger. Many systems use gravity to feed the cryogenic liquid in the tanks to the heat exchangers. While this is effective, many existing tanks do not permit bottom liquid withdrawal and cannot accommodate such an arrangement.

Accordingly, an object of the present invention is to provide a device whereby the pressure within a tank may be increased without significantly heating the liquid contained therein.

Another object of the present invention is to provide a device whereby the pressure within a tank may be increased without the use of pumps or compressors.

Still another object of the present invention is to provide a device whereby the pressure within a top withdrawal tank may be increased.

SUMMARY

The present invention is directed to a device for pressurizing a transfer tank containing cryogenic liquid. The invention features a tubular enclosure disposed within the cryogenic liquid. The tubular enclosure has an opening through which cryogenic liquid enters its interior. An electric heater element is disposed within the tubular enclosure so that, when it is energized, the cryogenic liquid is heated. As a result, a flow of cryogenic fluid is created. This flow contains a mixture of cryogenic gas and liquid. The mixture leaves the tubular enclosure and flows to a heat exchanger where the liquid portion of the mixture is vaporized. The gas produced thereby, along with the gas portion of the original mixture, is delivered to the tank to pressurize it. The device and its associated piping fit through the tops of existing cryogenic transfer tanks.

An insulating tube may encircle the tubular enclosure so as to provide a source of insulation. In addition, a ball may be positioned near the opening in the tubular enclosure so that a check valve is formed. This check valve prevents the flow of fluid out of the bottom of the tubular enclosure. Both of these features allow the heater to work more efficiently and reduce the undesired heating of cryogenic liquid that is not within the tubular enclosure.

For a more complete understanding of the nature and scope of the invention, reference may be had to the following detailed description taken in conjunction with the appended claims and accompanying drawings.

DESCRIPTION

Figure 1:
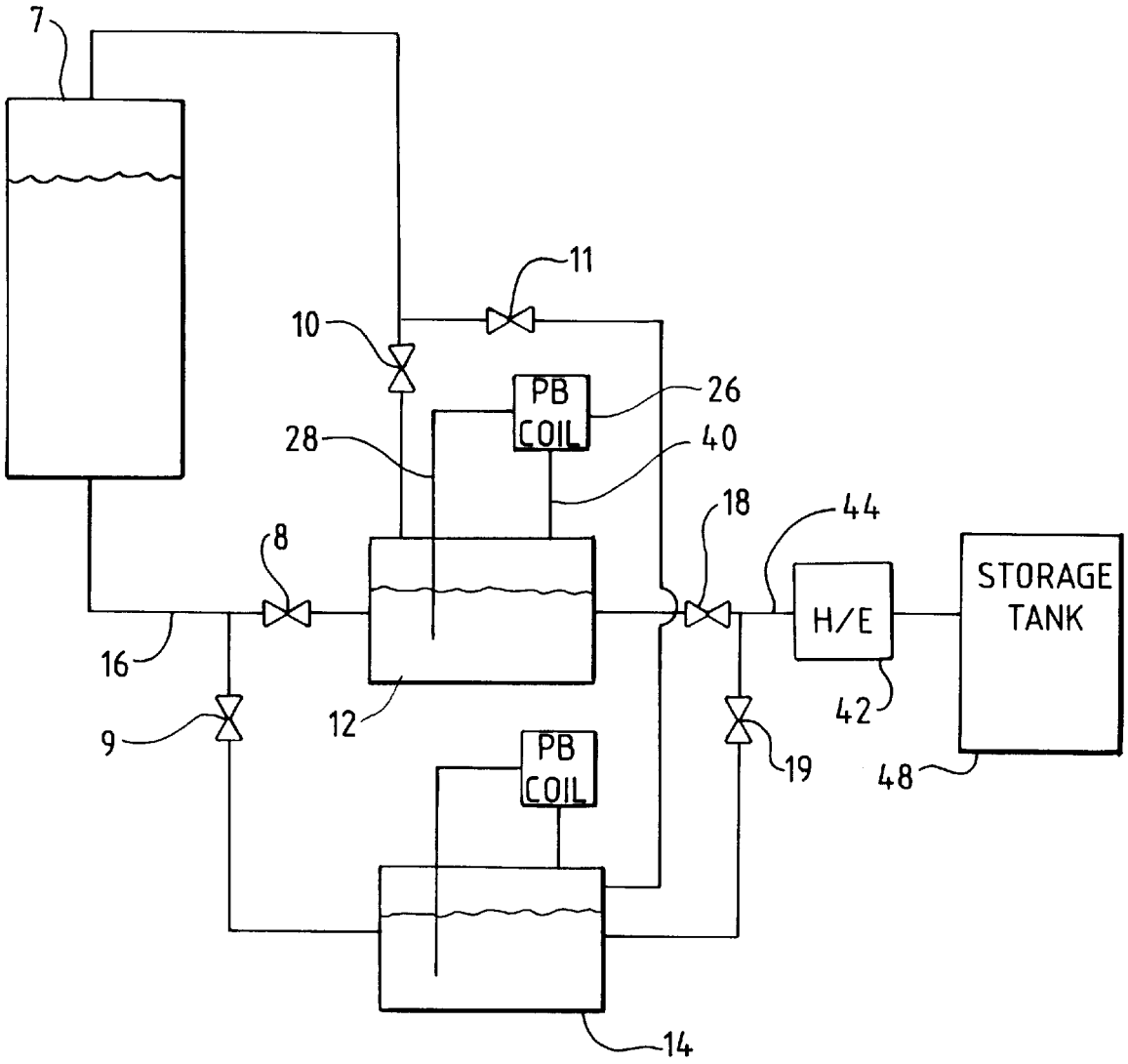
FIG. 1 is a schematic diagram of a high pressure cryogenic fluid delivery system that utilizes an embodiment of the present invention.

Referring to FIG. 1, a system that utilizes an embodiment of the high performance cryogenic pressure building device of the present invention is shown. A cryogenic liquid, such as liquid nitrogen or argon, is stored in cryogenic bulk storage tank 7 at a low pressure between 10 psi and its maximum allowable working pressure, typically 175 psi to 250 psi. The system may be configured via valves 8, 9, 10 and 11 so that bulk tank 7 communicates individually with either transfer tank 12 or 14 through conduit 16. Transfer tanks 12 and 14 are cryogenic transfer tanks that are smaller than bulk storage tank 7 and are capable of containing fluids at pressures up to 450–500 psi. Suitable tanks include the Laser-Cyl tank manufactured by MVE, Inc. of New Prague, Minn.

The system is able to dispense cryogenic gas nearly continuously because there is more than one transfer tank. For example, valves 8 and 10 are closed while transfer tank 12 is dispensing cryogenic liquid through open valve 18. During this time, transfer tank 14, empty from dispensing cryogenic liquid earlier, is filled from bulk tank 10 via gravity by opening valves 9 and 11 while valve 19 is closed. As an alternative to gravity filling, empty transfer tank 14 may be initially vented so that the pressure therein is reduced to atmospheric. As a result, when valves 9 and 11 are opened, cryogenic liquid flows to tank 14 due to the pressure difference between it and tank 7. After transfer tank 14 is filled with cryogenic liquid, and valves 9 and 11 are closed, it is pressurized as described below.

When tank 12 is empty, valve 18 is closed and valve 19 is opened so that filled and pressurized tank 14 begins dispensing. Valves 8 and 10 may then be opened so that tank 12 is refilled by gravity from bulk tank 7. As with tank 14, empty tank 12 may alternatively be vented and then filled by pressure differential. After valves 8 and 10 are closed, filled transfer tank 12 is pressurized so that the cycle may be repeated. The valves mentioned above may be solenoid activated and pressure sensors (not shown) may be positioned in transfer tanks 12 and 14 so that the system may be automated and controlled via a processor.

Continuing, and using transfer tank 12 as an example, once transfer tank 12 is substantially filled, and the flow of cryogenic liquid from bulk tank 7 is shut off, it may be pressurized to the desired transfer pressure, that is, approximately 400 psi, as follows.

Figure 2:
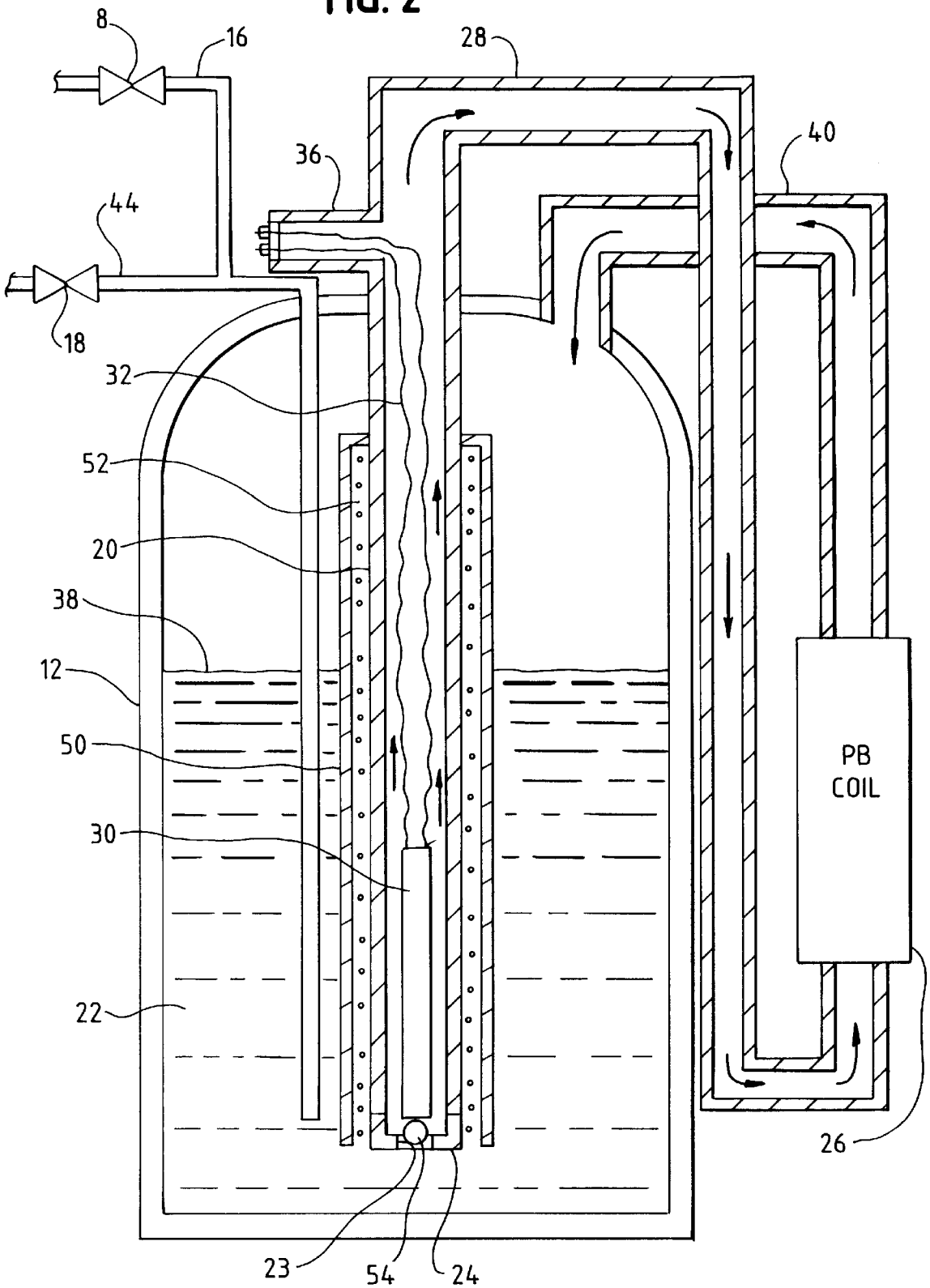
FIG. 2 is an enlarged, sectional side elevation view showing the detail of the present invention.

As shown in FIG. 2, a tubular enclosure 20 is disposed through the top of transfer tank 12 and down into the cryogenic liquid 22 stored therein. Tubular enclosure 20 contains an opening 23 in its bottom 24 and is in communication with the inlet of a pressure builder coil 26 via conduit 28. Conduit 40 leads from the outlet of pressure builder coil 26 back to the top of tank 12. As a result, the device of the present invention may be utilized to retrofit tanks without bottom liquid withdrawals so that they may be efficiently pressurized as described below.

Concentrically positioned within tubular enclosure 20 is an electric heater element 30. Heater element 30 may be held to the inner surface of tubular enclosure 20 with a bracket (which has been omitted for clarity) and is connected to electrical leads 32. Electrical leads 32 are connected to a source of electricity and enter tubular enclosure 20 through electrical feed through 36, which is pressure bearing to prevent the escape of vapor.

In operation, cryogenic fluid enters tubular enclosure 20 through the opening in bottom 24 and rises to the level 38 of liquid 22 in transfer tank 12. Electric heater element 30 is then energized so that the cryogenic liquid within tubular enclosure 20 is heated. As the heating continues, a portion of the liquid nearest heater element 30 experiences a decrease in density. This causes that portion of the cryogenic liquid to rise towards the top of tubular enclosure 20. As a result, an upward circulation within the liquid of tubular enclosure 20 is initiated. As heating continues further, a portion of the cryogenic liquid within tubular enclosure 20 begins to boil off. The vapor thus produced exits tubular enclosure 20 through conduit 28. As more vapor exits through conduit 28 a suction or siphon effect is created. This effect, in combination with the upward circulation of lower density fluid, causes the liquid within tubular enclosure 20 to rise above liquid level 38. As heating continues still further, a mixture of cryogenic gas and liquid will flow through conduit 28 to pressure builder coil 26.

As the mixture of cryogenic liquid and gas reaches pressure builder coil 26, the remaining liquid is converted to gas. This gas, along with the gas that was fed to pressure builder coil 26, is returned to the head space of transfer tank 12 via conduit 40 so that the pressure therein is increased. The combined operation of heater element 30 and pressure builder coil 26 allows the pressure within transfer tank 12 to be increased very rapidly. When the pressure within transfer tank 12 reaches a desired level, for example, 400 psi, heater element 30 is deactivated so that the thermodynamic pumping of cryogen to pressure builder coil 26 stops.

Referring to FIG. 1, the cryogenic liquid within transfer tank 12, as motivated by the head pressure therein, is permitted to flow to an optional heat exchanger 42 via liquid delivery tube 44 by opening valve 18. When the cryogenic liquid reaches heat exchanger 42, it is vaporized so that gas, if desired, may be provided directly to a use device or stored in storage tank 48. By omitting heat exchanger 42, the system may be used to alternatively provide high pressure liquid cryogen to a use device.

By heating only the cryogenic liquid within tubular enclosure 20, as opposed to heating all of the liquid 22 within transfer tank 12, the invention dramatically improves the performance of the tank in terms of "hold time." The hold time of the transfer tank is the length of time that a tank can hold a cryogenic fluid without venting. Heating all of the cryogenic liquid in the tank with an electric heating element will reduce hold time in that heat leaks in the tank will more quickly build the pressure therein to the safety valve pressure level. The invention solves this problem by confining the heating element, and the cryogenic fluid heated thereby, to the portion within the surrounding tube 20.

As shown in FIG. 2, tubular enclosure 20 may be encircled by a concentrically-positioned insulating tube 50 so that an annular insulation space 52 is defined. Annular insulation space 52 is open at the bottom and closed at the top. As a result, cryogenic vapor is trapped within annular insulation space 52 as transfer tank 12 is filled with cryogenic liquid 22. This provides tubular enclosure 20 with an insulating jacket that minimizes heat transfer from heater element 30 to the remaining cryogenic liquid 22 in transfer tank 12. In addition, a ball 54 may optionally be positioned within tubular enclosure 20, adjacent to the opening 23 in bottom 24, so that a check valve is formed. This prevents heated cryogenic fluid within tubular enclosure 20 from flowing back into the transfer tank 12.

By minimizing heat transfer, both insulating tube 50 and ball 54 improve the efficiency of the invention in that less heat is required to heat the cryogen within tubular enclosure 20. This results in lower energy consumption by heater element 30. In addition, insulating tube 50 and ball 54 improve the hold time performance of the tank.

While the preferred embodiments of the invention have been shown and described, it will be apparent to those skilled in the art that changes and modifications may be made therein without departing from the spirit of the invention, the scope of which is defined by the appended claims.

What is claimed is:

1. A device for pressurizing a tank containing a supply of cryogenic liquid comprising:

a) a tubular enclosure disposed within said supply of cryogenic liquid having an opening to permit a portion of the cryogenic liquid in the tank to enter the tubular enclosure;

b) a heater element disposed within said tubular enclosure to heat the cryogenic liquid therein to produce vapor;

c) a conduit for conveying said vapor from the tubular enclosure to an upper portion of said tank so that said tank is pressurized to a desired value; and d) an insulating tube concentrically disposed about said tubular enclosure so that an annular insulation space is defined therebetween.

2. The device of claim 1 wherein the heater element is electric.

3. The device of claim 1 wherein the annular insulation space features a closed top and an open bottom so that gas is trapped in the annular insulation space as the tank is filled with cryogenic liquid.

4. A device for dispensing cryogenic liquid from a tank without the use of a pump comprising:

a) a tubular enclosure disposed within said supply of cryogenic liquid having an opening to permit a portion of the cryogenic liquid in the tank to enter the tubular enclosure;

b) a heater element disposed within said tubular enclosure to heat the cryogenic liquid therein to produce vapor;

c) a conduit for conveying said vapor from the tubular enclosure to an upper portion of said tank;

d) a pressure builder coil in circuit with said conduit so that cryogenic liquid that is drawn into said pressure builder coil is vaporized and then delivered to the upper portion of the tank; and e) a liquid delivery tube in communication with said tank; whereby said tank is pressurized so that cryogenic liquid within said tank may be dispensed at a desired pressure through said liquid delivery tube.

5. The device of claim 4 further comprising a heat exchanger in circuit with said liquid delivery tube so that cryogenic gas may be dispensed at a desired pressure.

6. The device of claim 4 further comprising an insulating tube concentrically disposed about said tubular enclosure so that an annular insulation space is defined therebetween.

7. The device of claim 4 further comprising a ball positioned adjacent to the opening in said tubular enclosure, said ball functional as a check valve so that cryogenic liquid is prevented from flowing out of said tubular enclosure through said opening.

8. The device of claim 4 wherein the heater element is electric.

9. The device of claim 6 wherein the annular insulation space features a closed top and an open bottom so that gas is trapped in the annular insulation space as the tank is filled with cryogenic liquid.

10. A method of pressurizing a tank containing cryogenic liquid comprising the steps of:

a) segregating a portion of the cryogenic liquid within a tubular enclosure;

b) heating the portion of cryogenic liquid within the tubular enclosure to create a flow of vapor and liquid cryogen;

c) directing the flow of vapor and liquid cryogen to a pressure builder coil;

d) vaporizing the flow of liquid cryogen in the pressure builder coil so that a total amount of vapor is produced; and e) delivering the total amount of vapor to the tank so that the tank is pressurized to a desired value.

11. A device for pressurizing a tank containing a supply of cryogenic liquid comprising:

a) a tubular enclosure disposed within said supply of cryogenic liquid having an opening to permit a portion of the cryogenic liquid in the tank to enter the tubular enclosure;

b) a heater element disposed within said tubular enclosure to heat the cryogenic liquid therein to produce vapor;

c) a conduit for conveying said vapor from the tubular enclosure to an upper portion of said tank so that said tank is pressurized to a desired value; and d) a ball positioned adjacent to the opening in said tubular enclosure, said ball functional as a check valve so that cryogenic liquid is prevented from flowing out of said tubular enclosure through said opening.

12. The device of claim 11 wherein the heater element is electric.

* * * * *